US005577479A

United States Patent [19]

Popp

[11] Patent Number: 5,577,479

[45] Date of Patent: Nov. 26, 1996

[54] FUEL INJECTION SYSTEM FOR MOTOR VEHICLES

[75] Inventor: Heinz Popp, Roitham, Austria

[73] Assignee: Robert Bosch GmbH, Stuttgart, Germany

[21] Appl. No.: 380,788

[22] Filed: Jan. 30, 1995

[30] Foreign Application Priority Data

Apr. 23, 1994 [DE] Germany ..... 44 14 242.0

[51] Int. Cl.[6] ..... F02M 37/04

[52] U.S. Cl. ..... 123/458; 123/456; 123/447; 137/517

[58] Field of Search ..... 123/456, 447, 123/446, 506, 467, 497, 458, 198 DB; 137/498, 504, 517, 487.5; 251/129.16

[56] References Cited

U.S. PATENT DOCUMENTS

| | | | |
|---|---|---|---|
| 2,676,613 | 4/1954 | Baxter | 137/517 |
| 3,319,613 | 5/1967 | Begley | 123/458 |
| 3,949,713 | 4/1976 | Rivere | 123/458 |
| 4,338,902 | 7/1982 | Nakamura | 123/458 |
| 4,426,978 | 1/1984 | Sasaki | 123/458 |
| 4,539,959 | 9/1985 | Williams | 123/456 |
| 4,589,393 | 5/1986 | Jourde | 123/198 DB |
| 4,704,997 | 11/1987 | Endo et al. . | |
| 4,777,921 | 10/1988 | Mayaki et al. . | |
| 4,829,964 | 5/1989 | Asayama | 123/458 |
| 5,125,807 | 6/1992 | Kohler | 251/129.16 |
| 5,191,867 | 3/1993 | Glassey et al. . | |
| 5,215,113 | 6/1993 | Terry | 137/517 |
| 5,433,182 | 7/1995 | Augustin | 123/456 |

FOREIGN PATENT DOCUMENTS

| | | | |
|---|---|---|---|
| 0299337 | 1/1989 | European Pat. Off. . | |
| 0459429 | 12/1991 | European Pat. Off. . | |
| 0517991 | 12/1992 | European Pat. Off. . | |
| 531533 | 3/1993 | European Pat. Off. . | |
| 2125946 | 9/1972 | France . | |
| 2609503 | 7/1988 | France . | |
| 0146029 | 9/1982 | Japan | 123/458 |
| 906654 | 9/1962 | United Kingdom | 137/68 |
| 2041449 | 9/1980 | United Kingdom | 137/68 |
| 2263317 | 7/1993 | United Kingdom . | |

*Primary Examiner*—Carl S. Miller

*Attorney, Agent, or Firm*—Edwin E. Greigg; Ronald E. Greigg

[57] ABSTRACT

A fuel injection system for internal combustion engines having a high-pressure fuel pump, which supplies fuel from a low pressure chamber via a supply line into at least one high-pressure accumulation chamber. The at least one high-pressure accumulation chamber communicates via high-pressure lines with injection valves, which protrude into the combustion chamber of the engine to be supplied and whose opening and closing movements are each controlled by an electrically triggered control valve disposed in the high-pressure line at the injection valve. In order to prevent an uncontrolled escape of fuel in the event of a breach of a high-pressure line, flow limiting valves are additionally provided in all high-pressure lines, which valves close these lines when an admissible throughput quantity is exceeded.

20 Claims, 3 Drawing Sheets

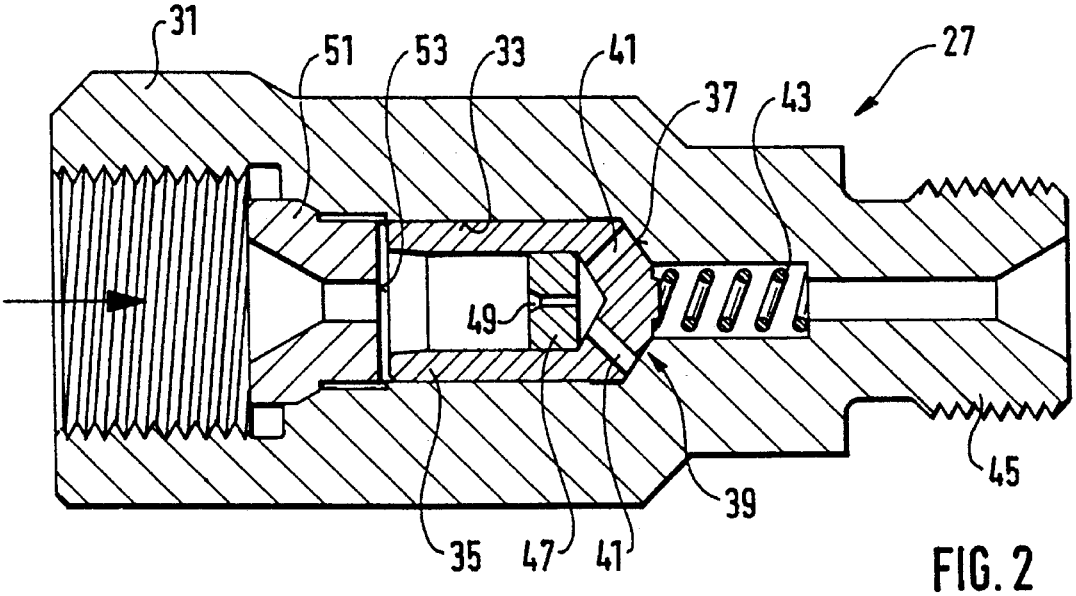
FIG. 2
FIG. 3
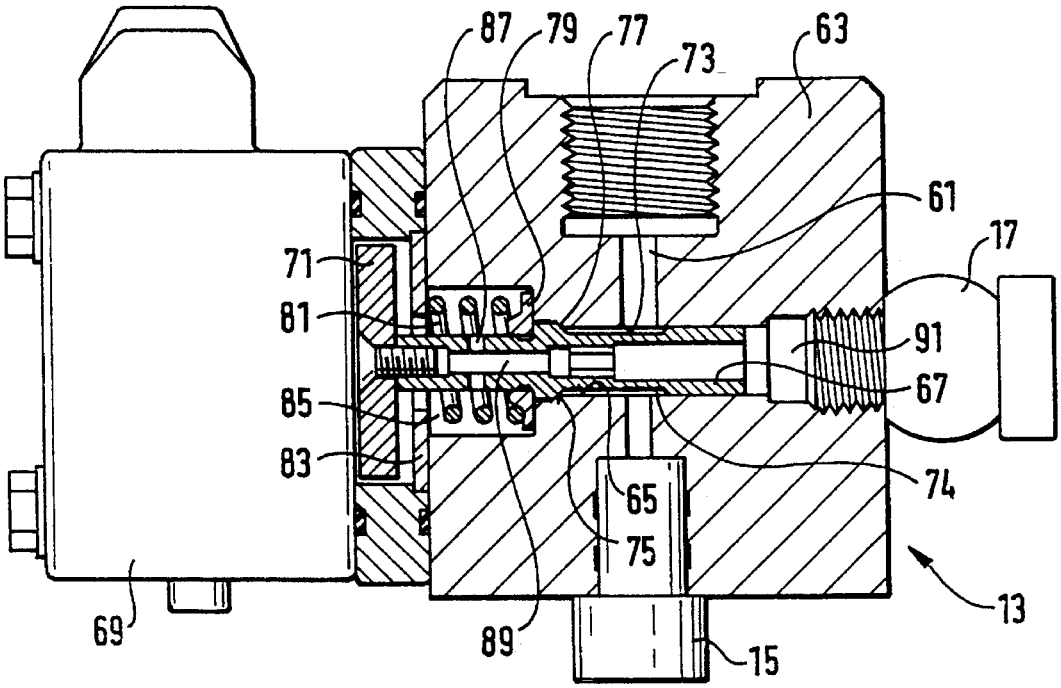

FUEL INJECTION SYSTEM FOR MOTOR VEHICLES

BACKGROUND OF THE INVENTION

The invention is based on a fuel injection system for motor vehicles as defined hereinafter. U.S. Pat. No. 4,777,921 discloses a fuel injection system of this kind in which a high-pressure fuel pump supplies fuel from a low pressure chamber into a high-pressure accumulation chamber, which communicates via high-pressure lines with the individual injection valves protruding into the combustion chamber of the engine to be supplied; this common pressure storage system (common rail) is maintained at a certain pressure by a pressure control device at the high-pressure pump so that regardless of the engine speed, the injection pressure at the injection valves can be determined over the entire operating performance graph of the engine to be supplied. To control the injection times and injection quantities at the injection valve, an electrically controlled control valve is inserted into the high-pressure lines at the injection valve; by its opening and closing, this control valve controls the high-pressure fuel injection at the injection valve.

However, the known fuel injection system has the disadvantage that a rapid pressure drop in the pressure storage system is not possible or is not possible to a sufficient extent if the engine speed is constantly changing or if the engine is stopped. Furthermore, the known fuel injection system has no effective safety device to protect against a pressure increase over an admissible maximal pressure or against an uncontrolled escape of fuel from the pressure storage system, e.g. as a result of a breach of a high-pressure line, so that it cannot satisfy the current requirements with regard to functional safety and emergency operation properties.

OBJECT AND SUMMARY OF THE INVENTION

The fuel injection system according to the invention has the advantage over the prior art that in it, a pressure limiting device is provided for rapid pressure relief and a flow limiting device for limiting the flow quantity or for closing off individual pressure lines when an allowable throughput quantity has been exceeded, which in addition to great operational safety also enables emergency operation of the engine in the event of valve jams, nozzle needle fractures, and high-pressure line damage.

It is particularly advantageous to insert a flow limiting valve into each high-pressure line and into the supply line so that in the event of a possible breach of a line, that line can be separately closed off. In this manner, a selective switching off of the damaged injection valve or its line can be carried out so that the remaining injection points can still remain functional and an emergency driving operation of the engine to be supplied is guaranteed. Furthermore, this closing of the damaged fuel carrying elements contributes to the operational safety of the entire engine since an uncontrolled escape of fuel is prevented in the event of an accident.

The arrangement of two parallel high-pressure accumulation chambers and of a flow limiting valve in each of the individual supply lines to these chambers advantageously also makes possible the described emergency driving operation in the event of a breach of one of the supply lines; then the second high-pressure accumulation chamber and thus half of the injection valves can still be supplied with fuel. The flow limiting valve is embodied in a structurally simple manner so that a valve spring holds the valve member lifted from its seat counter to the flow direction and thus holds the flow limiting valve open. The valve member, through which fuel flows, has a flow throttle which is adapted to the restoring force of the valve spring, so that when the flow quantity increases above an admissible maximal value, the throttle resistance at the flow throttle increases in such a way that the valve body is pressed onto its seat counter to the force of the valve spring and the flow limiting valve closes.

The valve spring is designed in an advantageous way so that together with the standing pressure in the high-pressure line or the high-pressure accumulation chamber, it holds the flow limiting valve open. However, if the standing pressure in the high-pressure line drops due to a breach and uncontrolled escape of fuel, the force of the valve spring alone is not enough to balance the pressure difference before and after the valve member and the valve member, as described above, is pressed into contact with its seat.

The pressure limiting valve with an integrated pressure sensor that is inserted directly into the supply line between high-pressure pump and accumulating chamber has the advantage that the pressure prevailing in the supply line can be very quickly converted into an actuation signal of the pressure limiting valve, which is preferably actuated by means of an electromagnet. Furthermore, by the direct insertion of the pressure sensor into the housing of the pressure limiting valve, further intervention in the supply line is unnecessary, which reduces the production cost. Through the use of an electromagnet for actuating the pressure-balanced valve member of the pressure limiting valve, very short switching times can be attained; the electromagnet can be triggered by an electric control unit that processes not only the pressure picked up by the pressure sensor, but also the operating parameters of the engine.

Furthermore, in order to be able to reliably prevent an exceeding of the admissible system pressure inside the pressure limiting valve and thus a destruction of its components, in the return line between the pressure limiting valve and the low pressure chamber, a bursting disk or a further pressure valve is advantageously provided, which, upon reaching a certain pressure, unblocks an enlarged opening cross section inside the return line and consequently then guarantees a rapid pressure relief of the pressure limiting valve.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 2 shows a section through the flow limiting valve, FIG. 3 shows a section through the pressure limiting valve having the connection of the return line and the electromagnet.

DESCRIPTION OF THE PREFERRED EMBODIMENT

Figure 1:
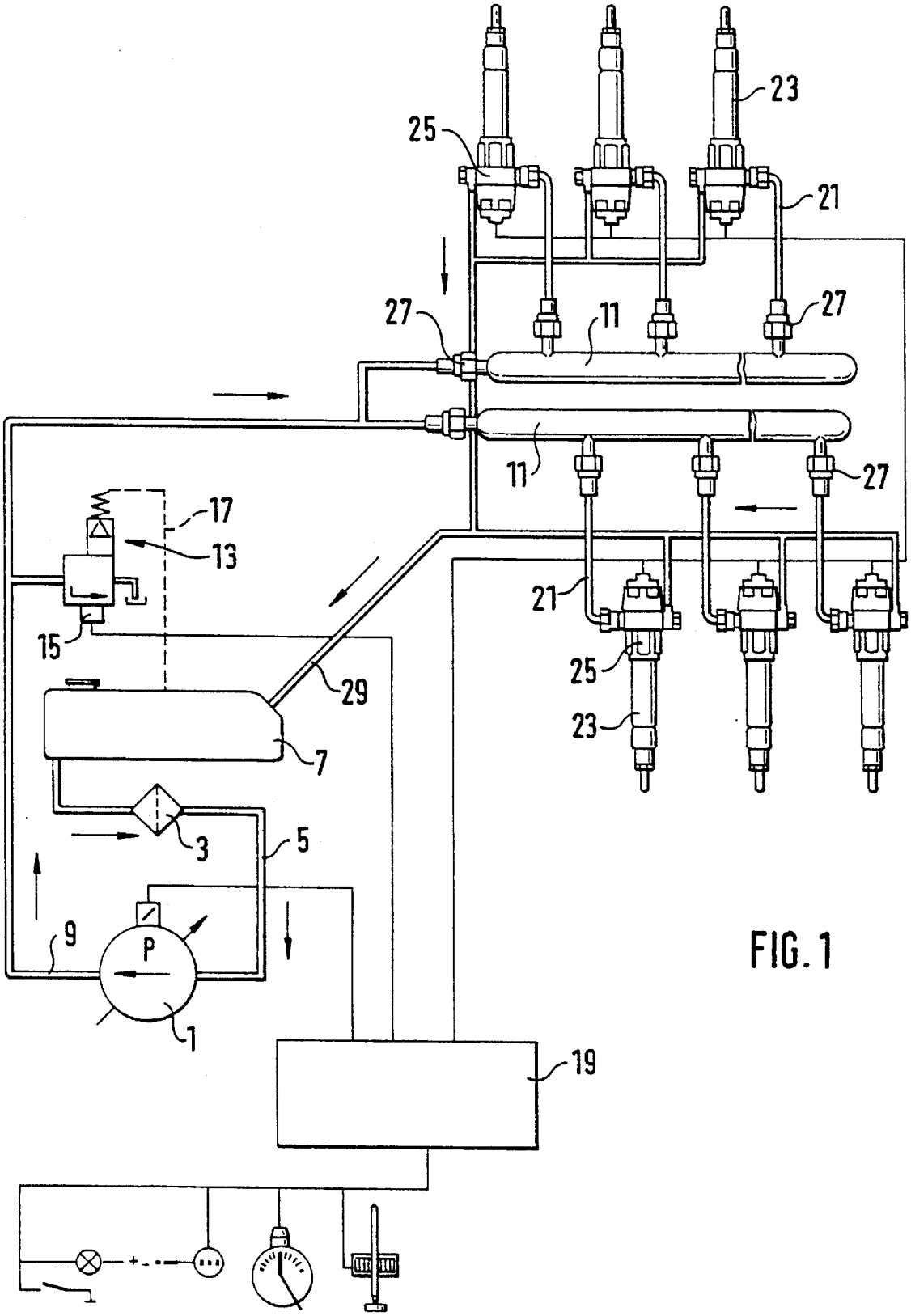
FIG. 1 shows a schematic representation of the construction of the fuel injection system.

In the fuel injection system shown in FIG. 1, a high-pressure fuel pump 1, which for example can be embodied as a piston pump, supplies fuel at high pressure, via an intake line 5 which has a filter 3, from a low pressure chamber 7 embodied as a fuel reservoir into two high-pressure accumulation chambers 11 disposed parallel to one another, via a supply line 9. To control the pressure in the supply line 9 and in the high-pressure accumulation chambers 11, a pressure limiting valve 13 having a pressure sensor 15 is inserted into the supply line 9, which valve on the other side communicates via a return line 17 with the low pressure chamber 7 and which can be opened by an electric control unit 19 as a function of the pressure in the supply line 9 and of operating parameters of the engine to be supplied; this control unit also controls the volumetric efficiency of the high-pressure fuel pump 1.

Furthermore, high-pressure lines 21 lead from the high-pressure accumulation chambers 11 to the individual injection valves 23 that protrude into the combustion chamber of the engine to be supplied; to control the injection event, an electric control valve 25 triggered by the electric control unit 19 is inserted at each injection valve 23 into the respective high-pressure line 21, via which control valve 25, a communication can be opened between the injection valve 23 and a relief line 29 leading to the low pressure chamber 7.

In the event of a breach of a high-pressure line 21 or of the supply line 9 at the high-pressure accumulation chambers 11, in order to prevent an uncontrolled escape of fuel from this leak, flow limiting valves 27 are additionally provided in these lines 9, 21, which valves are preferably disposed near to or directly at the high-pressure accumulation chambers 11.

These flow limiting valves 27, shown in FIG. 2, have a valve body 31 in which a through bore 33 embodied as a stepped bore is provided, in which a cup-shaped valve member 35 is guided so that it can move axially. The valve member 35 has a conical transitional surface between its cylindrical circumferential face and its closed end wall, with which transitional surface it forms a valve sealing surface 37, which cooperates with a valve seat 39 formed at a conical cross sectional transition of the through bore 33. Flow openings 41, preferably bores, are disposed in the valve sealing surface 37, on its end remote from the valve seat 39, via which openings when the valve member 35 is lifted from the valve seat 39, fuel can flow from the inside of the valve member 35 to the valve seat 39 and from there on into an adjoining bore section which contains a valve spring 43. The valve spring acts upon the valve member 35 in the opening direction of the flow limiting valve 27, which bore section adjoins the valve seat in the part of the valve seat 39 remote from the valve member 35. The valve member 35 is inserted into the through bore 33 in such a way that its open end points opposite the fuel flow direction to a connection of the valve body 31 at the supply line 9 or the high-pressure accumulation chamber 11, and its closed end, which carries the valve sealing surface 37, points in the flow direction to a connecting piece 45, to which the high-pressure accumulation chamber 11 (upon insertion in the supply line 9) or the high-pressure line 21 is attached.

In its interior, through which fuel flows, the valve member 35 additionally has a throttle insert 47 that precedes the flow openings 41; this insert has a throttle restriction 49 that is designed such that when the flow quantity increases over an adjustable maximal value, the throttle resistance at the throttle restriction 49 is increased in such a way that the valve member 35 is pressed with its valve sealing surface 37 onto the valve seat 39 counter to the force of the valve spring 43 and thus closes off the flow of fuel by means of the flow limiting valve 27. The valve spring 43, which is inserted into the bore section adjoining the valve seat 39 on its end remote from the valve member 35 and is kept secured there between a bore step and the closed face end of the valve member 35, is dimensioned so that when there is a maximal admissible flow quantity at the valve member 35, this spring 43, along with the standing pressure in the high-pressure line 21 or in the high-pressure accumulation chamber 11, reliably holds the valve member 35 lifted from the valve seat 39. However, if this standing pressure in the high-pressure line 21, which acts as an additional counterpressure in the opening direction, drops, e.g. by means of a breach of the high-pressure line 21 and an uncontrolled escape of fuel from this line, the force of the valve spring 43 alone is no longer sufficient to keep the valve member 35 lifted from the seat 39 counter to the force of the oncoming fuel flowing toward the throttle restriction 49, and the flow limiting valve 27 closes. To limit the stroke of the valve member 35 in the opening direction, a stop piece 51 having a flow opening is inserted, preferably screwed, into the through bore 33 of the valve body 31, the face end 53 of the stop piece 51 oriented toward the valve member 35 forms a stop, which cooperates with the open face end of the valve member 35. It is possible, via the depth to which this stop piece 51 is screwed in, to adjust the opening stroke motion of the valve member 35 and consequently the opening cross section at the valve seat 39.

Figure 4:
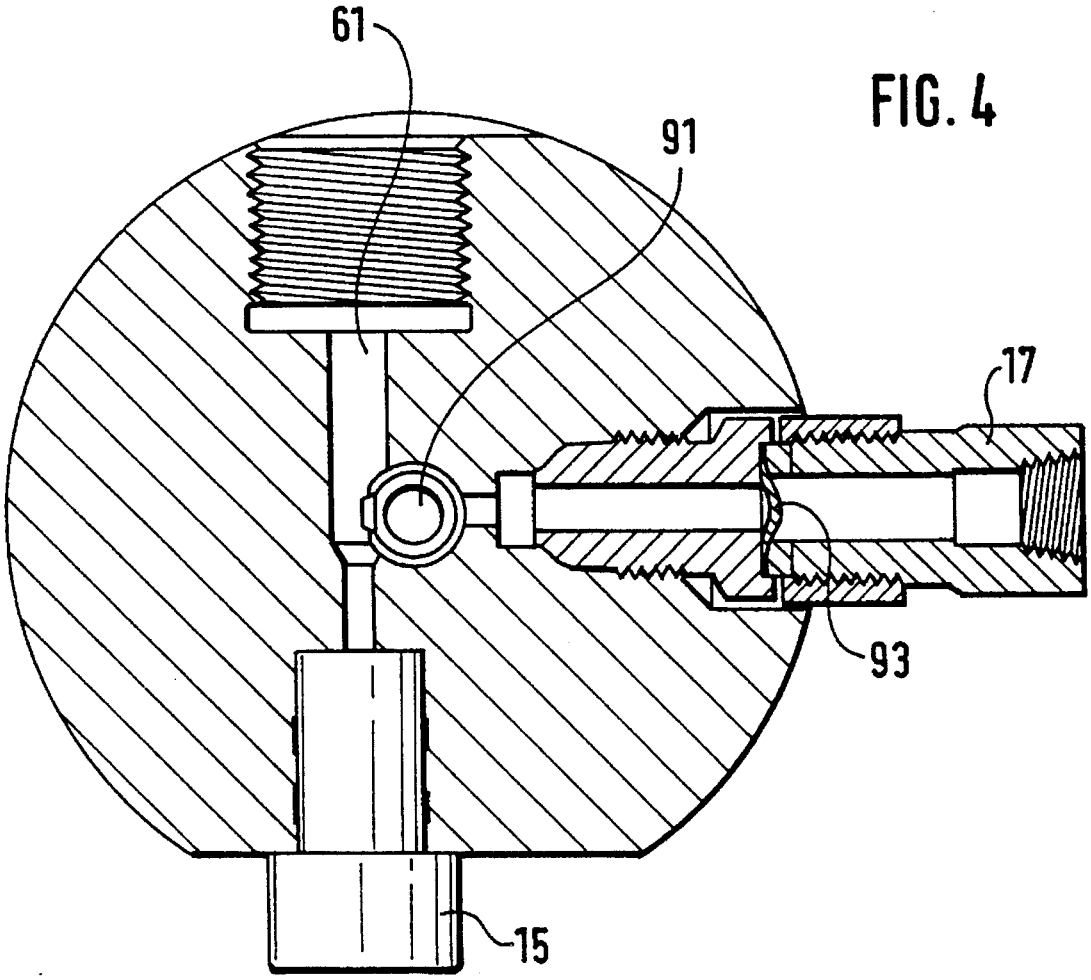
FIG. 4 shows a section through the part of the return line containing a bursting disk.

In the pressure limiting valve 13 shown in FIGS. 3 and 4, which is inserted into the supply line 9, the pressure sensor 15, not shown, is inserted directly into a high-pressure conduit 61 that communicates with the supply line 9, inside a housing 63 of the pressure limiting valve 13. This high-pressure conduit 61 intersects a guide bore 65 in the housing 63, in which guide bore a piston-shaped valve member 67 is guided so that it can move axially and can be actuated by an electromagnet 69, which for its part can be triggered depending upon the pressure picked up by the pressure sensor 15 as well as upon the operating parameters of the engine. With its one end, the valve member 67 is connected to an armature plate 71 of the electromagnet 69 and has an annular groove 73 at the level of the region of intersection with the high-pressure conduit 61; this annular groove 73 forms an annular high-pressure chamber 74 in the guide bore 65, via which chamber the two parts of the high-pressure conduit 61 adjoining the guide bore 65 communicate with one another. On its end oriented toward the electromagnet 69, via a conical cross sectional enlargement, the annular groove 73 comes to have an enlarged cross section and thus forms a valve sealing surface 75, which cooperates with a conical valve seat 77 adjoining the annular high-pressure chamber 74, which seat is formed by means of a cross sectional enlargement of the guide bore 65. Furthermore, the valve member 67 has a spring plate 79, which a restoring spring 81 engages, which on the other end is supported on an intermediate cap 83 to the electromagnet 69 and which holds the valve member 67 in contact with the valve seat 77. The end of the valve sealing surface 75 remote from the annular high-pressure chamber 74 adjoins a spring chamber 85, which contains the restoring spring 81 and which, via a cross bore 87 and a longitudinal bore 89 in the valve member 67, continuously communicates with a relief chamber 91 inside the guide bore 65, which chamber adjoins the end of the valve member 67 remote from the electromagnet 69, from which guide bore 65, the return line 17 leads. Furthermore, as shown in FIG. 4, a bursting disk 93 is inserted into the return line 17, which bursting disk 93, when a maximal pressure is exceeded in the return line 17 or in the relief chamber 91, unblocks an enlarged outflow cross section in the return line 17 and thus protects the pressure limiting valve 13 from an excess pressure load.

The pressure limiting valve works in the following manner. In the initial state, the restoring spring 81 keeps the valve member 67 in contact with the valve seat 77 so that no fuel escapes from the supply line 9. Should a rapid pressure drop develop in the supply line 9, which cannot be achieved via a regulation of the high-pressure fuel pump 1, the electromagnet 69 is supplied with power and moves the valve member 67 away from the valve seat 77 counter to the force of the restoring spring 81 so that the fuel, which is under constant high pressure, can flow out of the high-pressure conduit 61 via the annular high-pressure chamber 74, along the valve seat 77 into the spring chamber 85 and from there via the cross and longitudinal bores 87, 89 into the relief chamber 91 and on into the return line 17. A direct determination of the pressure conditions is possible via the pressure sensor 15 inserted into the high-pressure conduit 61 so that a very rapid and precise pressure regulation of the supply line pressure is possible. If the pressure in the supply line 9 has reached a certain value, the electromagnet 69 is switched off once again and the valve member 67 is pressed once more with its valve sealing surface 75 onto the valve seat 77 so that the pressure limiting valve 13 closes.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines having a high-pressure fuel pump (1), which supplies fuel from a low pressure chamber (7) via a supply line (9) into at least one high-pressure accumulation chamber (11), which communicates via high-pressure lines (21) with injection valves (23), said injection valves protrude into the combustion chamber of the engine to be supplied and opening and closing movements of the injection valves are each controlled by an electrically triggered control valve (25) disposed in the high-pressure line (21) at the injection valve (23), a flow limiting valve (27) is inserted in the supply line (9) which limits a maximal fuel flow quantity into said at least one high-pressure accumulation chamber (11) and into each high-pressure line (21).

2. The fuel injection system according to claim 1, in which at least two high-pressure accumulation chambers (11) are provided, which are independent of and disposed parallel to each other and the high-pressure fuel pump (1) communicates with each of said high-pressure accumulation chambers (11) via a flow limiting valve (27) secured to each of the supply lines (9) and to said high-pressure accumulation chambers.

3. The fuel injection system according to claim 1, in which each flow limiting valve (27) is embodied of a valve member (35), inserted into a valve body (31), said valve member (35) is held having a valve sealing surface (37) lifted from a valve seat (39) by a valve spring (43) cooperating with the valve counter to the flow direction of the fuel flowing through the valve, wherein the valve member (35), through which fuel flows, has a throttle insert (47) which has a throttle restriction (49) that is laid out so that when the flow quantity increases over an adjustable maximal value, the throttle resistance at the throttle restriction (49) is increased in such a way that the valve member (35) is pressed with its valve sealing surface (37) onto the valve seat (39) counter to the force of the valve spring (43), and closes off the flow of fuel through the flow limiting valve (27).

4. The fuel injection system according to claim 2, in which the flow limiting valve (13) is embodied of a valve member (35), inserted into a valve body (31), said valve member (35) is held having a valve sealing surface (37) lifted from a valve seat (39) by a valve spring (43) cooperating with the valve counter to the flow direction of the fuel flowing through the valve, wherein the valve member (35), through which fuel flows, has a throttle insert (47) which has a throttle restriction (49) that is laid out so that when the flow quantity increases over an adjustable maximal value, the throttle resistance at the throttle restriction (49) is increased in such a way that the valve member (35) is pressed with its valve sealing surface (37) onto the valve seat (39) counter to the force of the valve spring (43), and closes off the flow of fuel through the flow limiting valve (27).

5. The fuel injection system according to claim 3, in which the valve member (35) of the flow limiting valve (27) is embodied as cup-shaped, having a conical transitional surface between a cylindrical circumferential face and a closed end wall, said conical transitional surface forms the valve sealing surface (37) that cooperates with the conical valve seat surface (39) formed on the valve body, and having flow openings (41) in the transitional surface, which adjoin the valve sealing surface (37) on a side remote from the valve seat and which are preceded upstream by the throttle insert (47) inside the valve member (35).

6. The fuel injection system according to claim 4, in which the valve member (35) of the flow limiting valve (27) is embodied as cup-shaped, having a conical transitional surface between a cylindrical circumferential face and a closed end wall, said conical transitional surface forms the valve sealing surface (37) that cooperates with the conical valve seat surface (39) formed on the valve body, and having flow openings (41) in the transitional surface, which adjoin the valve sealing surface (37) on a side remote from the valve seat and which are preceded upstream by the throttle insert (47) inside the valve member (35).

7. The fuel injection system according to claim 5, in which an opening stroke motion of the valve member (35), which is guided axially displaceably in a through bore (33) in the valve body (31), is defined by means of the contact of an open, annular face end remote from the valve seat with a stop piece (51), which has a through opening and is preferably screwed into the valve body (31).

8. The fuel injection system according to claim 6, in which an opening stroke motion of the valve member (35), which is guided axially displaceably in a through bore (33) in the valve body (31), is defined by means of the contact of an open, annular face end remote from the valve seat with a stop piece (51), which has a through opening and is preferably screwed into the valve body (31).

9. The fuel injection system according to claim 3, in which the valve spring (43) is disposed in the valve body (31) in a section of the through bore (33) adjoining the end of the valve seat (39) remote from the valve member (35), and is fastened between a closed end wall face of the valve member (35) and a bore step.

10. The fuel injection system according to claim 4, in which the valve spring (43) is disposed in the valve body (31) in a section of the through bore (33) adjoining the end of the valve seat (39) remote from the valve member (35), and is fastened between a closed end wall face of the valve member (35) and a bore step.

11. A fuel injection system for internal combustion engines having a high-pressure fuel pump (1), which supplies fuel from a low pressure chamber (7) via a supply line (9) into a high-pressure accumulation chamber (11), which communicates with injection valves (23), said injection valves protrude into the combustion chamber of the engine to be supplied and whose opening and closing movements are each controlled by an electrically triggered control valve (25) inserted into the high-pressure line (21) at the injection valve (23), a directly controlled flow limiting valve (27) is inserted into the supply line (9) between the high-pressure fuel pump (1) and the high-pressure accumulation chamber (11), a pressure sensor (15) that is integrated in a housing (62) controls the pressure in the supply line (9) and controls an opening of a pressure limiting valve (13) depending upon the fuel pressure in supply line (9).

12. The fuel injection system according to claim 11, in which a valve member (67) of the pressure limiting valve (13) is actuated by an electromagnet (69), whose armature plate (71) is connected to one end of the valve member (67) and which moves the valve member (67) in an opening direction of the pressure limiting valve (13), counter to a force of a restoring spring (81) fastened between a spring plate (79), which engages the valve member (67), and an intermediate cap (83).

13. The fuel injection system according to claim 12, in which the valve member (67) has a sealing surface (75), formed by means of a conical cross sectional enlargement, which cooperates with a conical valve seat (77) in the housing (63) of the pressure limiting valve (13), said valve seat (77) is formed by means of a cross sectional enlargement of a guide bore (65), which axially guides the valve member (67).

14. The fuel injection system according to claim 13, in which the valve member (67) has an annular groove (73), which discharges at the valve sealing surface (75) and extends in a region of a high-pressure conduit (61) in the housing (63), said high pressure conduit intersects the guide bore (65) and communicates with the supply line (9), the annular groove thus forms an annular high-pressure chamber (74) in the pressure limiting valve (13).

15. The fuel injection system according to claim 13, in which an end of the valve sealing surface (75) of the valve member (67), which end is remote from the annular high-pressure chamber (74), adjoins a spring chamber (85), which contains the spring plate (79) and the restoring spring (81) and which, via a cross bore and a longitudinal bore (87, 89) in the valve member (67), constantly communicates with a relief chamber (91), which adjoins the end of the valve member (67) remote from the electromagnet (69), from which relief chamber (91) a return line (17) leads into the low pressure chamber (7).

16. The fuel injection system according to claim 15, in which in the return line (17), a pressure relief means is provided, which unblocks an enlarged outflow cross section in the return line (17) when a certain maximal pressure is exceeded in the pressure limiting valve (13).

17. The fuel injection system according to claim 16, in which said pressure relief means is a bursting disk (93).

18. The fuel injection system according to claim 16, in which said pressure relief means is a pressure valve.

19. The fuel injection system according to claim 14, in which the pressure sensor (15) is inserted into the high-pressure conduit (61) inside the housing (63) of the pressure limiting valve (13).

20. The fuel injection system according to claim 12, in which the electromagnet (69) is triggered by means of an electric control unit (19), depending upon the pressure picked up by the pressure sensor (15) and upon the operating parameters of the engine as well.

* * * * *